United States Patent [19]

Ershov et al.

[11] 4,011,744

[45] Mar. 15, 1977

[54] METHOD AND MEANS FOR SHAPING PARTS BY HYDRAULIC EXTRUSION

[76] Inventors: Vladislav, Ivanovich Ershov, ulitsa Volgina, 19, kv. 16; Nikolai Dmitrievich Livenko, ulitsa Profsojuznaya, 100, korpus 4, kv. 198, both of, Moscow, U.S.S.R.

[22] Filed: Feb. 25, 1975

[21] Appl. No.: 552,780

Related U.S. Application Data

[62] Division of Ser. No. 408,004, Oct. 19, 1973, Pat. No. 3,910,086.

[30] Foreign Application Priority Data

Mar. 30, 1973 U.S.S.R. ..... 1902339
July 5, 1973 U.S.S.R. ..... 1931501

[52] U.S. Cl. ..... 72/57; 72/60
[51] Int. Cl.[2] ..... B21D 26/04
[58] Field of Search ..... 72/28, 57, 54, 60, 63, 72/347, 58, 56; 29/421; 425/387 R, 389

[56] References Cited

UNITED STATES PATENTS

| | | | |
|---|---|---|---|
| 2,284,773 | 6/1942 | Sivian et al. | 72/57 |
| 2,728,317 | 12/1955 | Clevenger et al. | 72/58 |
| 2,960,141 | 11/1960 | Rutter | 72/58 |
| 3,420,089 | 1/1969 | Myers | 72/351 |
| 3,566,650 | 3/1971 | Johnson | 72/60 |
| 3,715,902 | 2/1973 | Fuchs, Jr. | 72/60 |

*Primary Examiner*—Milton S. Mehr

[57] ABSTRACT

The proposed method for shaping parts by hydraulic extrusion allows of deforming the blank by different pressures exerted upon different blank zones. This principle is embodied in a device which comprises a vessel housing a plurality of auxiliary vessels whereof the edges are pressed against the blank, defining closed cavities therewith. Liquid under pressure is supplied into each of these cavities.

Thanks to such an arrangement, the parts manufactured have a negligible wall thickness error.

The design of the proposed device permits manufacturing double-curvature parts.

1 Claim, 6 Drawing Figures

METHOD AND MEANS FOR SHAPING PARTS BY HYDRAULIC EXTRUSION

The present application is a division of the parent application Ser. No. 408,004, filed Oct. 19, 1973, now U.S. Pat. No. 3910086.

BACKGROUND OF THE INVENTION

The present invention relates to methods and equipment for pressure shaping of metals and more particularly to methods for shaping parts by hydraulic extrusion and devices utilizing such methods.

This invention may find application in various branches of mechanical engineering where it may be required to obtain complex-shaped parts, such as, for instance, convexo-concave pieces, with walls of uniform thickness.

It is widely practiced in the art to shape parts by hydraulic extrusion whereby a blank is deformed by water supplied under pressure.

It is likewise known in the art to employ hydraulic extruders comprising a vessel communicating with a source of pressurized liquid supply the blank being mounted on said vessel, and clamping means fastening the blank about the outer periphery thereof to the vessel. Besides, a die with a cavity shaped like the desired part is mounted on the blank. The clamping means in the known extruder is constituted by a plate with a hole or a ring arranged intermediate the vessel and the blank so as to press the blank edge against the die.

The pressure of the blank against the vessel is to provide for the tightness of the vessel through the entire process of part shaping. This pressing force is provided in the known extruders by hydraulic presses or special devices formed as massive trusses coupled with hydraulic cylinders.

The die of the known extruder is generally made of steel or concrete reinforced with steel elements which provide the required degree of stiffness and which enable the die to withstand the force of pressure thereof against the vessel as well as the pressure of the liquid at the final instant of blank deformation when the blank comes into contact with the die. The cavity of the die is vented to the atmosphere to remove air in the process of part formation.

Extruding parts by the known method in the known extruder, pressurized liquid is supplied into the vessel and the pressure of the liquid is gradually raised to the value required to deform the blank. The blank edge clamped between the die and the vessel is likewise deformed, becoming smaller, thicker and forming folds or corrugations. The linear displacement of the blank edge is determined by the extrusion ratio set for each kind of material depending on its mechanical properties, as well as on the size of the part and the thickness of the blank.

The liquid transmits to the blank a pressure which is constant over its entire surface. The shape of the blank in the process of extrusion, before it is pressed against the die, is set randomly depending on the size of the blank and the mechanical properties of the blank material.

The known method for shaping parts by hydraulic extrusion has limited application for the reason that the parts manufactured thereby have walls manifestly differing in thickness. The wall thickness non-uniformity reaches 45 percent, with the corresponding deterioration of quality. According to the known method, extrusion is usually carried out at such pressures of the liquid as would permit avoiding loss of stability — folding — in the blank zone adjacent the clamping means. To this end, the pressure in the vessel is raised so as to slightly exceed the value required to deform the central portion of the blank, with the result that the blank material is thinned non-uniformly in the process of extrusion. This constitutes a material drawback of the known method for shaping parts by hydraulic extrusion.

The known hydraulic extruder has further disadvantages, among other things, the unavoidable need for a die. The latter is usually very bulky and heavy; furthermore, the die is extremely labour-intensive in manufacture as the surface of its cavity is to be finished to allow for an elastic springback of the part after the deforming load as springback of the part after the deforming load has been relieved.

Another disadvantage of the known extruder consists in that, to put up the necessary force to press the blank to the vessel and the die to the blank, it takes either powerful hydraulic equipment or special clamping means which are to be manufactured specially for each part size and for each kind of material. For this purpose use is made of screw jacks or hydraulic cylinder mounted at various points about the periphery of the blank. Therefore, in the process of extrusion, the edges of the blank are pressed non-uniformly which constitutes a quality risk.

Besides, with this arrangement, the pressing force control in the process of extrusion is a difficult matter.

It is an object of the invention to provide such a method of shaping parts by hydraulic extrusion which would yield complex-shaped parts with walls of uniform thickness.

It is another object of the invention to provide a hydraulic extruder wherein liquid would be supplied to different blank zones at different pressures.

It is a further object of the invention to provide a hydraulic extruder of a fairly simple and reliable design.

With these objects in view, there is provided a method for shaping parts by hydraulic extrusion whereby blanks are profiled by liquid supplied under pressure, wherein, in accordance with the invention, liquid is supplied simultaneously to different zones of the blank at different pressures corresponding to the desired part shape which is periodically checked as it is evolving in the process of extrusion.

To implement the method of the invention and to attain the foregoing objectives, there is provided a device comprising a vessel, which communicates with a source of pressurized liquid supply and whereon the blank is mounted, as well as clamps to fasten the blank to the vessel about the periphery thereof. In accordance with the invention, in the head of the vessel there is installed with one end thereof a guide member carrying a plurality of auxiliary vessels sequentially arranged so as to reciprocate freely along the guide member and adapted to fit one into another. The edges of these auxiliary vessels are pressed against the blank so that each pair of adjacent vessels defines with the blank a hermetically sealed cavity, each cavity being hydraulically connected to the pressurized liquid supply. The areas of the outer and inner surfaces of each auxiliary vessel are determined by the difference in the loads exerted thereupon by the pressure of the liquid in said cavities adjoining the vessel on both sides so that the load inside the vessel is somewhat smaller than that outside the vessel.

In a device of this design, liquid may be supplied to different blank zones defined by the edges of the auxiliary vessels at different pressures to obtain parts with walls of uniform thickness.

If the part to be manufactured has an intricate shape comprising, for example, numerous mating convex and concave surfaces, it is preferred that the device should include, mounted on the blank, a vessel, such as the one described hereinabove. In the head of the vessel there is installed with one end thereof a guide member carrying a plurality of auxiliary vessels arranged so as to reciprocate freely therealong, said auxiliary vessels being adapted to fit one into another. The edges of said auxiliary vessels are clamped in the blank in the interspaces between the edges of the auxiliary vessels disposed beneath the blank so that each pair of adjacent vessels defines with the blank a hermetically sealed cavity, each cavity being hydraulically connected to the source of pressurized liquid supply. The areas of the outer and inner surfaces of each of the auxiliary vessels are determined by the difference in the loads exerted thereupon by the pressure of the liquid in the cavities adjoining the vessel on both sides so that the load inside the vessel is somewhat smaller than that outside the vessel.

In one embodiment of the invention, the guide member to carry the auxiliary vessels reciprocating therealong is constituted by a hollow bar connected to the movable member of a hydraulic cylinder, and carrying, sequentially fitted thereover, a plurality of springs which constrain the auxiliary vessels to stay at a certain distance one from another and which also serve to press the auxiliary vessels to the blank prior to the start of operating.

If the dimensions of the part in plan are smaller than those of the vessel, it is preferred that between the vessel and the blank there should be positioned at least one plate fastened to the blank and to the vessel by a clamp and having a hole to fit the contour of the part in plan.

Each of the auxiliary vessels disposed above the blank should preferably house a conduit rigidly connected thereto, which conduit is intended to vent the air out of the vessel as it is being filled with the liquid. The conduit has an outlet close to the edge of the vessel and comprises a portion extending beyond the confines of the extruder parallel to the guide member and equipped with a valve which serves, inter alia, to monitor the displacements of the auxiliary vessel in the process of blank deformation.

In an alternative embodiment of the invention, each of the auxiliary vessels has a bushing adjacent the head thereof, which bushing is fitted over the guide bar and carries a spring constraining the auxiliary vessels to stay apart one from another, the bushings of adjacent additional vessels being adapted to telescopically fit one into another.

These bushings may be used to vary the areas of the inner or outer surfaces of the auxiliary vessels to comply with the abovementioned ratio of the loads exerted by the pressure of the liquid thereupon.

BRIEF DESCRIPTION OF THE DRAWINGS

The present invention is illustrated both as to the method and apparatus thereof in the accompanying drawings, wherein.

DESCRIPTION OF THE PREFERRED EMBODIMENTS

Figure 1:
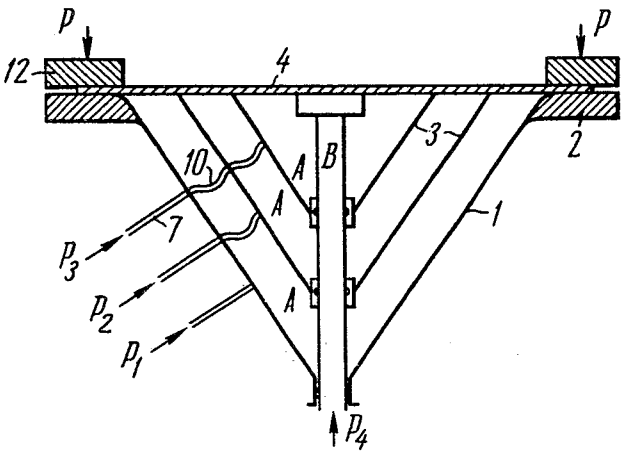
FIG. 1 is a schematic representation of a hydraulic extruder in accordance with the invention, shown before the start of operation.
Figure 2:
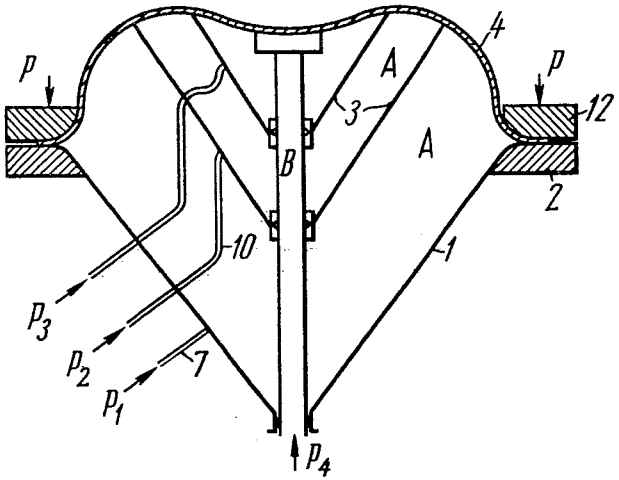
FIG. 2 is the hydraulic extruder of FIG. 1 in the process of shaping a part.

Referring now to FIG. 1, there will be seen to be schematically illustrated therein a hydraulic extruder set for operation, and in FIG. 2 the same hydraulic extruder as represented at the instant of part shaping effected by way of simultaneously supplying liquid to different portions of the blank under different pressures $P_1$, $P_2$, $P_3$ and $P_4$.

The proposed hydraulic extruder comprises a vessel 1 mounted on a base 2. The vessel 1 is shaped like a body of revolution, such as a cone or ellipsoid, and has relatively thick walls designed to withstand pressures of up to 100 atm. In the cavity of the vessel 1 there are a plurality of auxiliary vessels 3 arranged sequentially along a guide member installed in the head of the vessel 1. The number of the auxiliary vessels 3 is chosen depending on the size and shape of the vessel 1. On the vessel 1 there is mounted a blank 4 which is in contact with the edges of the auxiliary vessels 3 provided with seals 5. Between the blank 4 and two adjacent auxiliary vessels, for example 1 and 3 or 3 and 3, there are formed hermetically sealed auxiliary cavities A. Each of the auxiliary cavities A is hydraulically connected to pressurized liquid supply 6 by conduits 7 comprising reducing valves 8 which control pressure in each conduit 7. The conduits 7 extend into the wall of the vessel 1 through holes specially provided therein. These holes also house airtight inlets 9 formed as nipples. The airtight inlet 9 is connected on one side to the conduit 7 and on the other side to a flexible conduit 10. Each of the flexible conduits 10 is designed to supply the liquid to the respective auxiliary cavity A. In the walls of the auxiliary vessels 3, at the points where the flexible conduit 10 passes from one auxiliary cavity A to another, holes are defined with airtight inlets 9 fitted therein as well. Each conduit 7 is provided with a valve 11 to drain liquid from the respective auxiliary cavity A which is mounted on a branching-out conduit 11a, the latter inserted into a main which is connected to the pressurized liquid supply 6.

The areas of the outer and inner surfaces of each auxiliary vessel 3 are determined by the difference in the loads exerted thereupon by the pressure of the liquid in the auxiliary cavities A adjoining the auxiliary vessel so that the pressure load inside the vessel 3 should be somewhat lower than that outside this vessel 3. Accordingly the walls of each auxiliary vessel 3 are made gradually thickening or thinning from the edges toward the head thereof. If this condition is complied with, in each of the auxiliary cavities A there may be provided a pressure value to a certain extent higher than those in the adjacent lowerdisposed cavities A. At the same time the pressure differential between the adjacent cavities never rises beyond a safety limit up to which the joint between the edge of the respective auxiliary vessel 3 and the blank 4 stays airtight. The blank 4 is pressed against the edge of the vessel 1 by clamping means 12 formed as a ring with a hole conforming in shape to the contour of the part being manufactured in plan, the clamping ring being bolted to the vessel 1 (the bolts are not shown).

Figure 4:
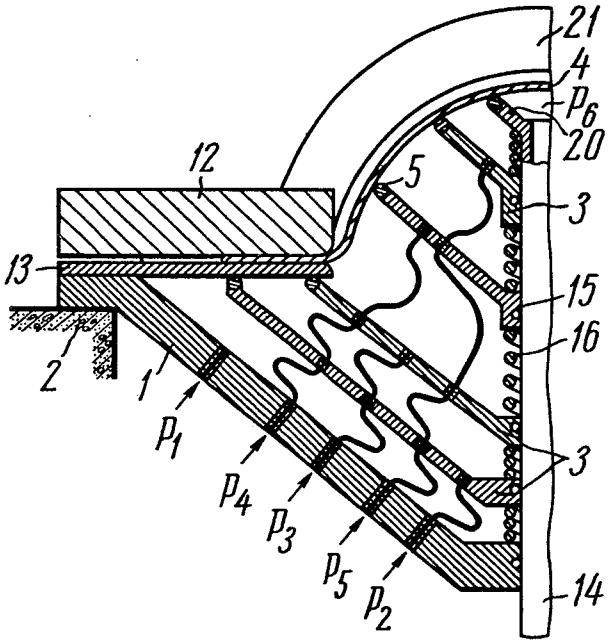
FIG. 4 is a view, partially in section, of an embodiment of the hydraulic extruder of this invention.

Should the extruded part and, hence, its blank fail to completely cover the vessel 1, use is made of a superimposed plate 13 (FIG. 4) with a hole conforming in shape to the contour of the part in plan. The plate 13 is mounted on the edges of the vessel 1 so as to span a certain number of the auxiliary cavities A. The blank 4 is positioned on the plate 13 and fastened thereto by the clamping means 12. The plate 13 must be stiff enough to withstand the pressure of the liquid in the auxiliary cavities A spanned thereby without strain.

Figure 3:
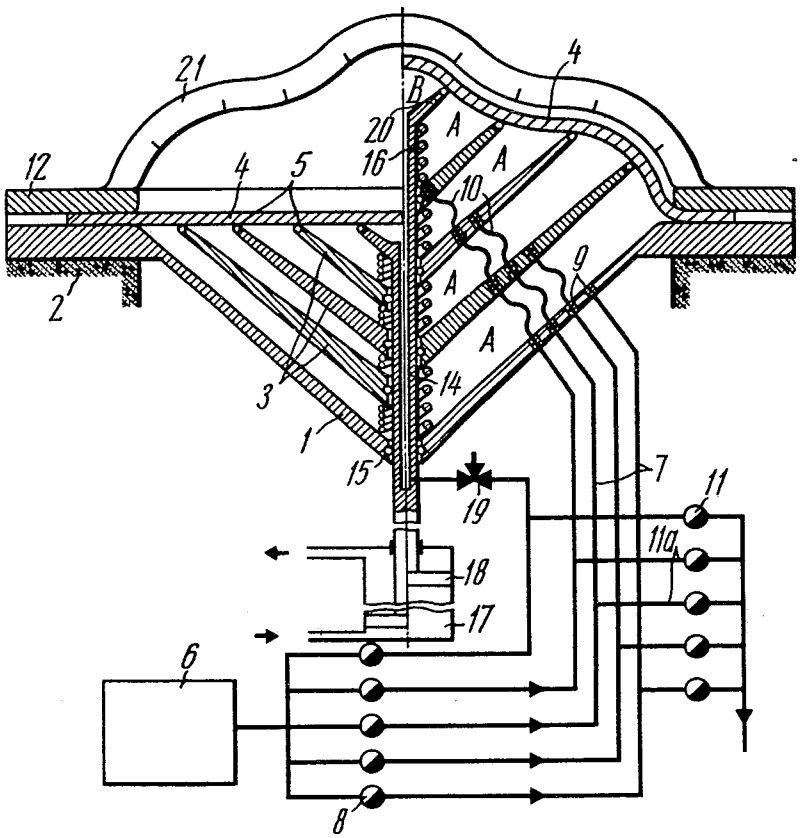
FIG. 3 is an elevational view of a hydraulic extruder, showing it in two positions: set for operation (left) and at the final instant of blank deformation.

The auxiliary vessels 3 are mounted in the vessel 1 so as to reciprocate freely along the guide member thereof. To this end, in the head portions of all vessels 1 and 3 there are defined holes coaxially one with another to receive a hollow bar 14 which serves as the guide member. These holes have fitted therein sealing rings 15 which envelop the hollow bar 14 and ensure the airtightness of the auxiliary cavities A. Over the hollow bar 14 there are fitted springs 16 which separate the auxiliary vessels 3 one from another and press the edges of the auxiliary vessels 3 against the blank 4 before the extruder is started. The hollow bar 14 is connected to the sliding member of a hydraulic cylinder 17 (FIGS. 3 and 5), in this case to a cylinder rod 18. Cavity B of the bar 14 is also hydraulically coupled via a T-valve 19 with the pressurized liquid supply 6. The free end of the bar 14 which is in contact with the blank 4 is formed as a flange 20 with a seal 5 adjoining the bar 14.

The T-valve 19 also serves to vent the cavity B of the bar 14 to the atmosphere after the extrusion process is over. The shape of the part being extruded is periodically checked by applying a template 21 (FIG. 3) which may be either flat or three-dimensional. When positioning the template 21 on the part, the former rests on the clamping means 12.

To manufacture convexo-concave pieces such as cylindrical half-rings or diaphragms, they employ a hydraulic extruder wherein on top of the blank 4 there is mounted a vessel 22 (FIG. 5) communicating with a pressurized liquid supply (not shown), with a plurality of auxiliary vessels 23 being mounted along a guide member fixed in the head of the vessel 22 with one end thereof. The edges of the auxiliary vessels 23 are pressed against the blank 4 in the interspaces between the edges of the auxiliary vessels 3 disposed therebeneath, so that between the blank 4 and each pair of adjacent vessels 23 airtight cavities C are formed. Each of the cavities C is hydraulically connected to a pressurized liquid supply (not shown). Just as with the auxiliary vessels 3, the areas of the inner and outer surfaces of the auxiliary vessels 23 are determined by the difference in the loads they experience from the pressure of the liquid in the cavities C adjoining each vessel 23 on both sides. And the pressure inside the vessel 23 is somewhat lower than that outside it, thereby ensuring that the joints between the edges of the vessels 23 with the seals 5 and the blank 4 remain airtight throughout the extrusion process. The vessels 23 are disposed in the vessel 22 so as to reciprocate freely along the guide member installed in the head thereof.

A hollow bar 24 identical with the one used for the vessels 3 is employed as the guide member. Over the bar 24 having a cavity D there are fitted springs 25 constraining the vessels 23 to stay apart one from another and pressing them to the billet 4. There is a stop 26 with a set screw (not shown) fitted on the upper end (as shown in the drawing) of the bar 24, i.e. beyond the vessel 22, which stop 26 serves to set the auxiliary vessels 23 in position for the start of operation.

As the cavities C are filled with the liquid, the air escapes therefrom through a connecting pipe 27 and float valves 28.

Each float valve 28 is installed at a portion of a conduit 29 which runs parallel to the guide bar 14. The other portion of each conduit 29 is disposed in the respective cavity C between the vessels 23 and the blank 4 and terminates in the upper portion (as shown in the drawing) of the cavity C. At the point where one portion of the conduit 29 adjoins the other the conduit 29 is fastened to the edge of the respective auxiliary vessel 23.

Besides, the float valves 28 are used as pointers indicating the displacements of the auxiliary vessels 23 in the process of part shaping so as to monitor the part shape by the magnitude of such displacements.

At the points where the conduits 29 pass through the walls of the auxiliary vessels 23 there are airtight inlets 30 fitted into the walls.

Figure 6:
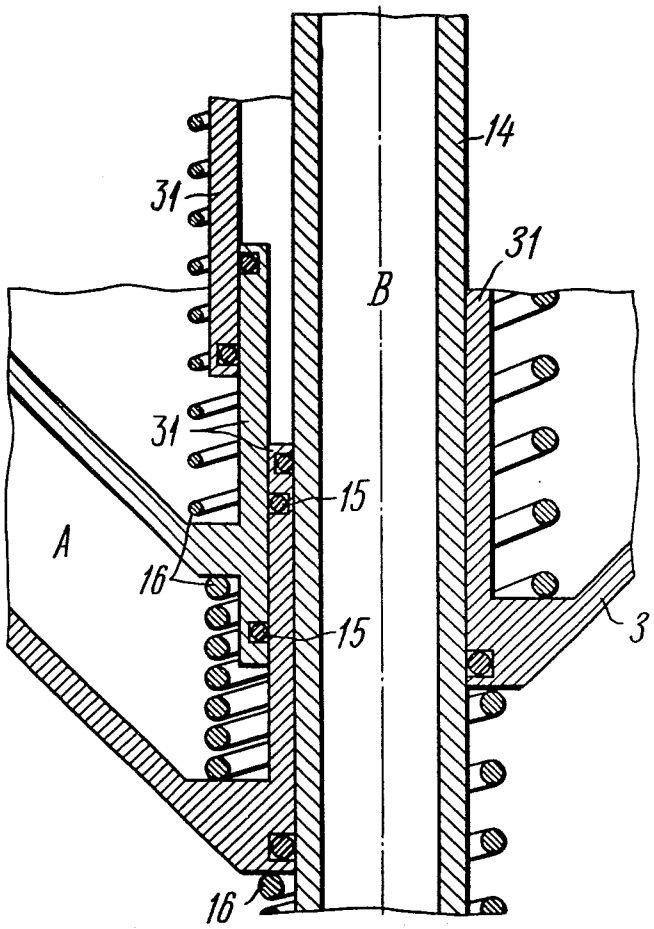
FIG. 6 is a blown-up view of position VI of FIG. 5.

In an alternative embodiment of the invention, each of the auxiliary vessels 3 or 23 is provided with a bushing 31 (FIG. 6) disposed adjacent the head of the vessel and fitted over the guide member of the vessel, viz. the hollow bar 14.

The bushing 31 carries a spring 16 which keeps the auxiliary vessels 3 or 23 apart one from another. The bushings 31 of adjacent auxiliary vessels 3 or 23 are adapted to telescopically fit one inside another so as to be able to move relative to one another in the process of part shaping. This kind of coupling of the auxiliary vessels 3 or 23 with the bar 14 is used in those cases when the pressure of the liquid in each successive cavity A or C formed with the peripheral portion of the blank 4 steadily rises, with the result that the area differential of the projections of the outer and inner surfaces of each of the auxiliary vessels 3 or 23, at a constant thickness of the vessel walls, will be determined by the wall thickness of the bushing 31. By varying the wall thickness of the bushing 31 it is possible to meet the above-mentioned condition as to the ratio of the liquid pressure values on the inside and outside of the auxiliary vessels 3 or 23.

The proposed hydraulic extruder operates in the following manner.

In the initial position before the start of operation, the reducing valves 8 are adjusted to a pressure value roughly equal to a third of the service pressure required deforming the blank 4. The bar 14 (FIG. 3) is driven by the rod 18 of the hydraulic cylinder 17 to the extreme lower position where it constrains the auxiliary vessels 3 kept apart by the springs 16 in a position wherein the edges thereof are level with or somewhat lower than the edge of the vessel 1. Then the blank 4 is positioned on the edges of the vessel 1 without pressing the former thereto, following which liquid is supplied into each cavity A through the reducing valves 8 and into the cavity B of the bar 14 through the T-valve 19 until all the cavities A have been filled. The clamping means 12 is mounted on the blank 4 and fixed on the vessel 1. Then the pressure in the hydraulic cylinder 1 is reduced to the atmospheric level in order to unlock the bar 14 and enable the bar flange 20 and the vessels 3 to be forced by the springs 16 upward until the seal 5 on the flange 20 and the edges of the vessels 3 come into close contact with the blank 4, dividing same into a plurality of zones. After that the liquid from the pressurized supply 6 is supplied successively into each of the cavities A, the pressure value being regulated by the reducing valves 8. The pressure in each cavity A depends on the shape of the part being extruded, on the mechanical properties of the blank material, its thickness and the radius of curvature of the part in each zone; this pressure value is determined by computation. As the pressure in the cavities A varies the blank 4 is being shaped into the required part, the evolving shape periodically checked by applying the template 21. As the liquid is simultaneously supplied under different pressures to different zones of the blank 4, the thickness of the billet is changed uniformly in the process of deformation. As a result, the part produced has a wall thickness within reasonable limits of accuracy. To prevent loss of stability of that zone of the blank 4 which adjoins the clamping means 12 as the part is being extruded, this zone is deformed at a pressure somewhat higher than that required for its deformation. The central zones of the blank 4 experience a pressure not exceeding the deformation pressure.

Upon completion of the hydraulic extrusion process, the reducing valves 3 are closed and the valves of the conduits 7 are opened, causing part of the liquid to flow out of all cavities A and out of the cavity B back to the supply source 6, so that the pressure in all these cavities drops to the atmospheric level.

Then the T-valve 19 is set in a position wherein the cavity B is connected to the atmosphere, and the bar 14 is moved by the rod 18 of the hydraulic cylinder 17 downward to its initial position, causing the seals 5 on the edges of the vessels 3 to be detached from the part, and the liquid from the cavities A and B flows by gravity back to the source 6. Then the clamping means 12 is removed and the finished part is taken off the vessel 1 of the extruder.

The mean wall thickness error of the parts manufactured by the proposed technique was shown by tests to stay within 5 percent, whereas similar parts manufactured out of the same material by the prior art method on the prior device have a wall thickness error as high as 10 percent. These data were obtained in the manufacture of a vessel bottom of diameter 205 and height 38 mm.

The device in accordance with the invention comprised two cavities; liquid at a pressure of 12 atm. was supplied into the central cavity and at a pressure of 20 atm. into the other one. The material of the blank was an aluminum alloy.

Figure 5:
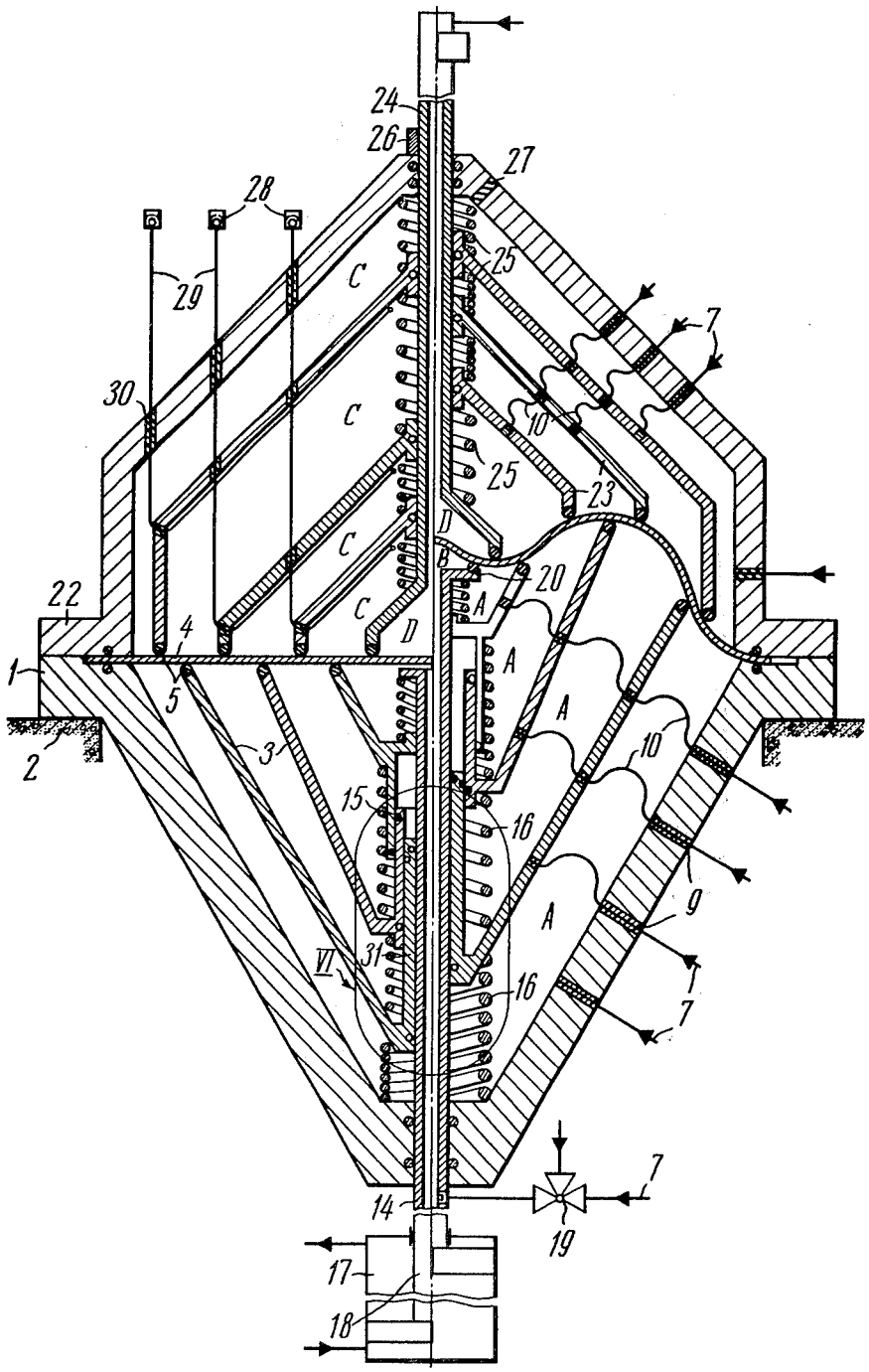
FIG. 5 is an elevational view, partially in section, of an embodiment of the hydraulic extruder of this invention.

The hydraulic extruder of FIG. 5 is employed to manufacture convexo-concave parts; its principle of operation is as follows.

The guide bar 14 is driven by the rod of the hydraulic cylinder 17 to its extreme lower position, while the bar 24 is moved to its extreme upper position and fixed therein with the help of the stop 26. In this position, the auxiliary vessels 3 are arranged below the joint line of the vessels 1 and 22, while the auxiliary vessels 23 are arranged above that line. Then, the vessel 22 together with the auxiliary vessels 23 and the bar 24 is removed from the vessel 1, whereupon liquid is supplied into the cavities A and B until the vessel 1 has been filled. After that the blank 4 is positioned on the vessel 1, the vessel 22 with the auxiliary vessels 23 is placed on the blank 4 and fastened to the vessel 1 by bolts (not shown), ensuring that the edge of the blank 4 is pressed to the vessels 1 and 22 with a required force. Then, with the help of the hydraulic cylinder 17 and its rod 18, the bar 14 is drived upward until the flange 20 has come into contact with the blank 4, thereby releasing the springs 16 so that the vessels 3 move upward until their edges come into contact with the blank 4 by way of the sealings 5 of the vessel edges. Then the stop 26 is unlocked so that the springs 25 force the bar 24 and the auxiliary vessels 23 into contact with the blank 4.

The cavity D of the bar 24 and the cavities C are filled with liquid until the air has completely escaped through the connecting pipe 27 and the conduits 29 with the valves 28, whereupon the valves 28 are closed.

After that the liquid again starts to be supplied into the cavities A, B, C and D at a pressure roughly equal to a third of the deformation pressure of the blank 4 in order to seal off the cavities A, B, C and D. This completed, the pressure in each of the cavities is gradually raised to a predetermined value and the blank 4 is deformed.

In the process of deformation of the blank 4, the conduits 29 with the values 28 rigidly coupled with the edges of the auxiliary vessels 23 are displaced therewith, so that the displacements of certain points of the blank 4 in the process of extrusion can be measured, affording a possibility of monitoring the evolving shape of the part. In order to improve the quality of shape control, the auxiliary vessels 3, too, have similar displacement pointers.

With the edges of the auxiliary vessels 23 disposed in the interspaces between the edges of the vessels 3, the shape control quality rises; furthermore, such an arrangement, whereby the blank is divided into a plurality of zones experiencing different pressures, broadens the scope of the proposed extruder. By the right choice of the pressures exerted on the different zones of the blank 4, a convexo-concave parts of intricate shapes may be manufactured.

Since each of the zones of the blank 4 is relatively small in size, the risk of loss of stability of the blank 4, particularly near the point where the blank 4 is squeezed between the vessels 1 and 22, is all but nonexistent.

Besides, with the liquid on both sides of the blank 4 exerting pressure thereupon, the material of the blank 4 is subjected to compressive stresses, which is another factor preventing the loss of stability of the blank 4 and permitting the depth of extrusion to be increased.

Upon completion of the shaping process, the pressure of the liquid in the cavities A, B, C and D is brought down to the atmospheric level. Then the bar 14 is driven downward to ensure communication of the cavities A one with another and with the cavity B of the bar 14, whereas the bar 24 is driven upward to ensure communication of the cavities C one with another and with the cavity D of the bar 24. The connecting pipe 27 is opened, venting the cavities C to the atmosphere. This causes part of the liquid to flow back to the supply source through the conduits 10 and 7. The remaining liquid is pumped out of the cavities C through the cavity D of the bar 24, simultaneously opening the T-valve 19, and venting the cavity B of the bar 14 to the atmosphere. This will cause the air to force the liquid out of the cavities A and B through the conduits 7 and 10 back to the supply source.

Finally, the vessels 1 and 22 are separated and the finished part is removed.

Just as in the case described hereinabove, should the blank 4 be smaller in size than the cross-section of the vessels 1 and 22, then use is made of plates 13 disposed on both sides of the blank 4. The plates 13 are clamped together with the blank 4 between the vessels 1 and 22, and pressurized liquid is supplied into the cavities A and C spanned by the plates 13, so that the pressure of the liquid clamps the plates 13 to the blank 4, thereby providing for the displacement of the edge of the blank 4 as it is being deformed without loss of stability.

What we claim is:

1. A method for shaping parts by hydraulic extrusion, comprising the steps of: profiling a sheet metal workpiece by liquid simultaneously supplied to different zones of said workpiece at different pressure values corresponding to the shape of said workpiece, said workpiece having a central part and a flange section, said liquid comprising a variable-pressure deforming agent, the variable liquid pressure increasing the wall thickness in the central part of said workpiece and decreasing the wall thickness in the flange section of the workpiece the elasticity of the workpiece remaining substantially unchanged by said liquid.

* * * * *